US005445228A

United States Patent [19]

Rathmell et al.

[11] Patent Number: 5,445,228

[45] Date of Patent: Aug. 29, 1995

[54] METHOD AND APPARATUS FOR FORMATION SAMPLING DURING THE DRILLING OF A HYDROCARBON WELL

[75] Inventors: James J. Rathmell, Rockwall; Charles L. Vavra, Lucas, both of Tex.

[73] Assignee: Atlantic Richfield Company, Los Angeles, Calif.

[21] Appl. No.: 88,169

[22] Filed: Jul. 7, 1993

[51] Int. Cl.[6] ..... E21B 49/04

[52] U.S. Cl. ..... 175/4; 175/44

[58] Field of Search ..... 175/4, 4.54, 4.55, 20, 175/44, 50, 58

[56] References Cited

U.S. PATENT DOCUMENTS

| | | | |
|---|---|---|---|
| 3,227,228 | 1/1966 | Bannister | 175/4 |
| 4,004,642 | 1/1977 | Dardick | 175/4.5 |
| 4,474,250 | 10/1984 | Dardick | 175/1 |
| 4,609,056 | 9/1986 | Colle, Jr. et al. | 175/4 |

OTHER PUBLICATIONS

Wolk, "The Mechanics of Sidewall Sampling", *Technical Memorandum,* vol. 7, No. 1 (Dresser Atlas, Mar. 1976), pp. 1–12.

Honeybuorne, "Measurement While Drilling", Symposium on the 75th Anniversary of the Oil Technology Course at the Royal School of Mines (1988).

Sales information regarding "CST Sidewall Sampler" (Schlumberger, undated).

Bonner, et al., "Logging While Drilling: A Three-Year Perspective", *Oilfield Review* (Elsevier, Jul. 1992), pp. 4–21.

Sales information regarding CORGUN (Western Atlas International, undated).

*Primary Examiner*—David J. Bagnell

*Attorney, Agent, or Firm*—Vinson & Elkins

[57] ABSTRACT

A tool for obtaining samples of the formation surrounding the wellbore, and method of obtaining such samples, is disclosed. The tool is implemented within a sub in a bottomhole assembly, preferably within side-pocket mandrels in the outer surface of drill collar pipe. The tool includes a series of sampling bits that may be fired into the surrounding formation by the activation of an explosive charge, and also includes an electronic unit for detecting a signal from the surface and activating the charge in response thereto. The signal may be communicated by way of mud-pulse telemetry, or by any other known telemetry technique. Separate groups of sampling bits, with separate switch and power units, may be provided to provide redundant operation; a decoder is included in this alternative, to allow for selection of one of the groups.

19 Claims, 4 Drawing Sheets

METHOD AND APPARATUS FOR FORMATION SAMPLING DURING THE DRILLING OF A HYDROCARBON WELL

This invention is in the field of oil and gas exploration and production, and is more specifically directed to the analysis of the earth in the vicinity of a well borehole.

BACKGROUND OF THE INVENTION

The high cost of drilling wells for the production of oil and natural gas has continued to increase over recent years. This increase in drilling cost is due at least in part to the increasing depth and difficulty of location of remaining hydrocarbon reserves, considering that large and shallow reservoirs around the world have already been exploited. Considering also that drilling costs increase at least linearly with well depth, new hydrocarbon wells are increasingly expensive, especially for those wells in hostile surface or sub-surface environments. The additional factor of market price volatility, especially in recent years, has still further increased the previously significant pressure on producers to drill only where the likelihood of paying production is high.

Confidence in the success of a particular well can be obtained from accurate measurement of the surrounding formation prior to and during the drilling operation. Of course, the seismic survey of the drilling region is an important factor in the success of a well. In addition, accurate assessments of the quality and location of the reservoir and its surrounding sealing formations are also critical in play evaluation, especially in so-called "wildcat" areas that have had little previous drilling activity. These assessments of reservoir and seal quality are generally based upon the analysis of physical samples of the sub-surface formations, such samples known as rock samples.

According to one conventional rock sampling technique, cuttings obtained during drilling are analyzed to determine the composition, porosity, and other lithology parameters of the formation. The analysis of drill cuttings to obtain rock samples is known to have certain drawbacks, however. One such drawback is that the size of the individual cuttings are often so small that one may not be able to accurately determine the petrophysical properties (e.g., porosity, permeability, saturation) of the formation from which they came. Secondly, variations in the circulation time of the cuttings in the drilling fluid prior to sampling cause uncertainty in the determination of the true depth from which the analyzed fragments originated. This uncertainty is compounded by the possible caving in of the wellbore or by mixture of the cuttings from different intervals, such that the sampled cuttings are a mixture of constituents from different depths, rather than discrete lithologies corresponding to formations at different depths. In addition, the drilling fluid causes dispersion of clay-cemented particles so that these particles are disaggregated and lost from the sample; the distribution of rock types remaining in the sample are thus heavily biased toward those types having non-reactive cements. The cumulative effect of these factors makes the analysis of drilling cuttings inexact, at best.

An alternative conventional technique for obtaining rock samples of a wellbore is the use of a wireline sidewall sampling tool after the wellbore has been drilled and logged. Examples of such tools include the CORGUN tool available from Western Atlas International and the CST sidewall core sampler available from Schlumberger Well Services. Additional description of the mechanics of sampling utilizing conventional tools of this type may be found in Wolk, "The Mechanics of Sidewall Sampling", *Technical Memorandum,* Volume 7, No. 1 (Dresser Atlas, March, 1976), pp 1–12. These conventional sampling tools operate by activating a charge to fire small sampling bits into the surrounding formation; upon retrieval of the tool, the sampled formation remaining in the sampling bits can then be analyzed.

The use of a wireline sampling tool provides useful and relatively accurate information regarding the formations through which the wellbore has been drilled. However, these samples are generally obtained too late to allow for adjustments in the drilling operation itself, and as such have limited impact on the success of the well being drilled.

The significant expense associated with wireline logging for many well operations, particularly in hostile or remote locations, has resulted in the popularity of measurement-while-drilling (MWD) logging, where a tool is included within the drill string to sense downhole conditions and communicate the same to the surface during the drilling operation. Total drilling cost may be greatly reduced by use of MWD logging rather than wireline logs, because the cost of wireline service equipment and personnel at the drilling site is avoided. However, the absence of wireline equipment and service personnel at the MWD drilling site causes the incremental cost of wireline core samples for an MWD well to be prohibitive.

Another drawback to wireline sampling results from degradation of the wellbore over time. One type of time-dependent degradation is enlargement of the hole due to reaction of the formation with the drilling fluid over time, resulting in the swelling, weakening and eventual loss of formation. Other time-dependent degradation mechanisms include dispersion of the formation by the drilling fluid and stress release effects at the wellbore location, each of which also cause loss of formation structure. In addition, invasion of the formation by water-based filtrate will, over time, reduce the oil saturation in the formation, making a later-obtained sample quite inaccurate. "Filter cake" may also build up on the wellbore sidewalls as drilling fluid liquid filters out of the wellbore into the surrounding formation, in which case subsequent sampling of the wellbore sidewalls may retrieve a large amount of filter cake but only a small amount of formation.

As is well known in the art, conventional wireline sampling of the wellbore sidewalls is typically performed at least one or more days after the formation of the wellbore. Because of the time-dependent degradation effects noted above, however, wireline samples may have low sample volumes (e.g., where the formation has been lost or where significant filter cake is formed), or may not accurately portray the true formation composition (e.g., where the saturation is reduced by water-based filtrate).

In addition, conventional wireline sampling cannot be used in wells that are oriented in substantially a horizontal direction, as the shallow angle prevents the tool from being lowered to the depth of interest. Wireline logging and sampling in such wells require the use of coiled tubing to force the tools into the horizontal wellbore; as is well known in the art, the cost of coiled tubing wireline operations is much greater even than conventional wireline logging. The cost of coiled tubing equipment and personnel solely to perform sidewall sampling is therefore especially prohibitive for substantially horizontal MWD (i.e. non-wireline logged) wells.

Another technique for obtaining rock samples is the wellknown coring technique, in which a core drill bit is used periodically during the drilling operation to obtain a core sample of the earth. While providing highly accurate samples, these coring operations are quite expensive considering that trip times of on the order of six to twenty-four hours are required. As a result, conventional coring is limited to portions of certain key reservoir intervals, and important seal and marginal reservoir lithologies thus may not be sampled in early formation evaluation. Core sampling also has limited usefulness in early well decisions.

By way of further background, many types of MWD tools and techniques are well known in the art. Surveys of MWD techniques may be found in Honeybourne, "Measurement While Drilling", Symposium on the 75th Anniversary of the Oil Technology Course at the Royal School of Mines (1988), and in Bonner, et al., "Logging While Drilling: A Three-Year Perspective", *Oilfield Review* (Elsevier, July 1992), pp. 4–21. Conventional MWD tools are included as a special joint of pipe in the drill string, generally near the drill bit, and include transducers and other sensors for determining downhole conditions during the drilling operation. Examples of the types of information obtainable by conventional MWD include drilling mechanics, drilling direction and inclination, short-normal resistivity and gamma ray detection. In addition, modern MWD tools also utilize logging-while-drilling (LWD) measurements to obtain information similar to that obtained from wireline logs, such as correlation, resistivities, shale volume, porosity, lithology, rugosity, and free gas detection.

One known technique for communicating MWD parameters or alarm conditions to the surface is referred to as stress wave telemetry, where vibrations of the drill string itself communicate the data, and direct communication of electrical signals along wire conductors within the drill string. Another well known technique for downhole-to-surface telemetry is so-called mud-pulse telemetry, where periodic restriction or venting of a flowing drilling mud stream at a downhole location creates pressure variations in the mud stream that are detectable at the surface. An alternative technique for effecting mud-pulse telemetry utilizes the variable rotation of a slotted rotor relative to a slotted stator (such an apparatus referred to as a "mud siren") to produce a frequency modulated signal in the mud stream pressure that is detectable at the surface.

By way of further background, the use of downhole mechanisms to fire projectiles into the formation surrounding the drill bit have been described in U.S. Pat. Nos. 4,004,642 and 4,474,250. These references describe the firing of projectiles into the earth to assist in the excavation of the borehole, and also to produce acoustic signals for detection at the surface from which the lithology of the formation surrounding the bit may be measured. The '642 patent noted above describes the use of ammunition rounds, fired through a gun barrel, as the projectiles.

It is an object of the present invention to provide a method and apparatus for obtaining rock samples from the sidewalls of the wellbore during the drilling operation.

It is a further object of the present invention to utilize a downhole tool to effect the sampling.

It is a further object of the present invention to provide such an apparatus that may be controlled to obtain the necessary samples at selected times, so that accurate reservoir and seal analysis may be obtained in sufficient time to allow adjustment of the drilling operation.

Other objects and advantages of the present invention will be apparent to those of ordinary skill in the art having reference to the following specification, in combination with the drawings.

SUMMARY OF THE INVENTION

The invention may be incorporated into a downhole tool for obtaining samples of the formation surrounding a wellbore, by way of a special drill collar containing a percussion sidewall tool. The sidewall tool incorporates several side-pocket mandrels, each having sampling bits that may be fired perpendicular to the wellbore at a selected time under the control of a signal from the surface. The tool preferably contains a receiver that can detect a mud pulse signal generated at the surface, responsive to which firing of the sampling bits is controlled. In operation, the sidewall sampling tool remains passive during the actual drilling operation. At such time as the tool has reached a depth of interest, as determined by MWD parameters and usually when the drill string is about to be removed from the borehole to change the drill bit, sampling is initiated by communicating a signal from the surface to the sampling tool to fire one or more of the sampling bits into the formation. Withdrawal of the tool from the wellbore retrieves the formation samples, allowing for on-site analysis of the surrounding formation. As a result, formation sample analysis is available during drilling, based upon which the drilling operation may be adjusted according to actual sub-surface conditions.

DETAILED DESCRIPTION OF THE PREFERRED EMBODIMENTS

Figure 1:
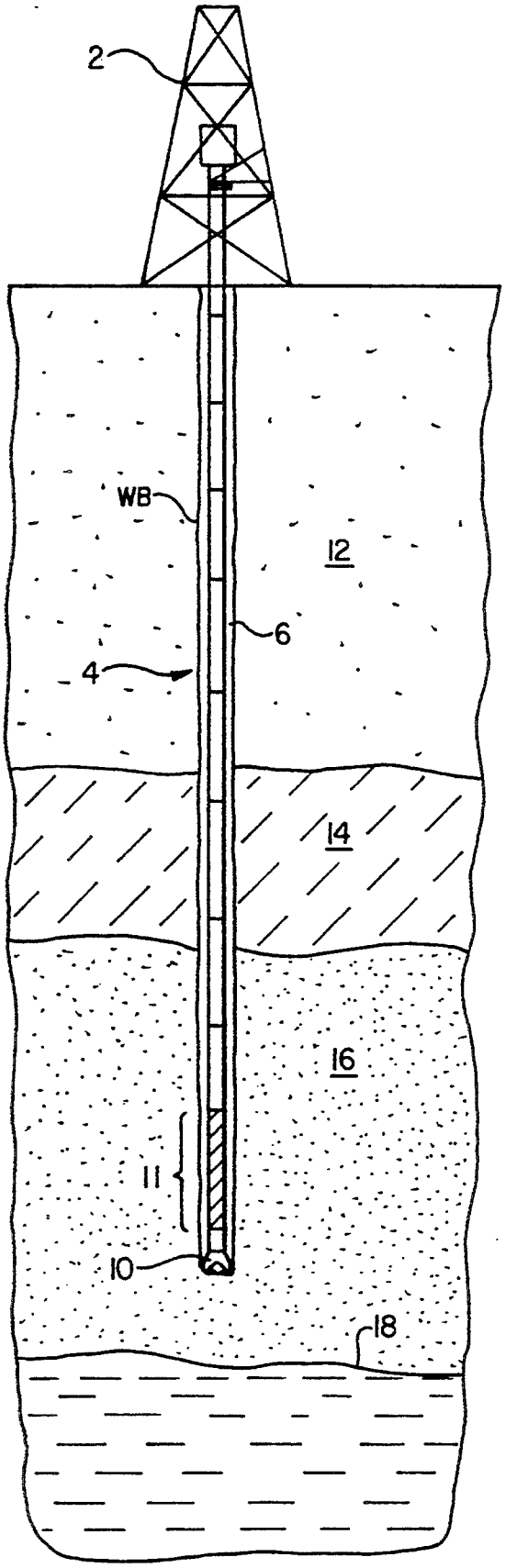
FIG. 1 is a schematic diagram of a drilling operation in cross-section, illustrating an application of the embodiment of the invention.

Referring now to FIG. 1, a drilling operation with which a preferred embodiment of the invention is used will be described. A conventional drilling rig 2 is shown as powering drill string 4, which conventionally consists of multiple sections 6 of drill pipe. Sections 6 are connected to one another by tool joints in the conventional manner. Rotary drill bit 10 is connected at the distal end of drill string 4 from the surface; alternatively, bit 10 may be a jet bit, spud bit, or other type of drill bit conventional in the art. As shown in FIG. 1, drill bit 10 is connected to bottom-hole assembly (BHA) 11, which in turn is connected to sections 6 of drill string 4. According to this embodiment of the invention, BHA 11 will house the sidewall sampling tool of the present invention, as will be described hereinbelow.

The drilling operation illustrated in FIG. 1 results in wellbore WB excavated by the drilling apparatus through a number of varied formations 12, 14, 16, 18. As is well known, the geology of formations 12, 14, 16, 18 is of great interest in the production of hydrocarbons. In particular, if formation 16 in the example of FIG. 1 is a reservoir of oil and gas, parameters such as pore structure, porosity, permeability, mineralogy, lithology, and other properties of formation 16, as well as such properties of formation 18 directly thereabove which seals the reservoir of formation 16, are of particular importance.

According to the preferred embodiment of the invention, BHA 11 includes a conventional drill collar by way of which drill bit 10 is coupled to the remainder of the drill string 4, and also includes conventional MWD (or LWD) transducers for measuring certain parameters during drilling. According to the preferred embodiment of the invention, bottom-hole assembly 11 also includes a sidewall-sampling-while-drilling ("SWD") tool for obtaining rock and formation samples from the sidewall of wellbore WB, and which is controlled as part of a system including communications and control equipment at the surface. As will be described in further detail hereinbelow, this SWD tool is preferably implemented as one of several subs within bottom-hole assembly 11. The conventional measurement-while-drilling (MWD) sensors and transducers in bottom-hole assembly 11 are preferably located in another sub below the SWD tool, and are used to determine the locations at which sidewall samples are to be obtained.

Figure 2:
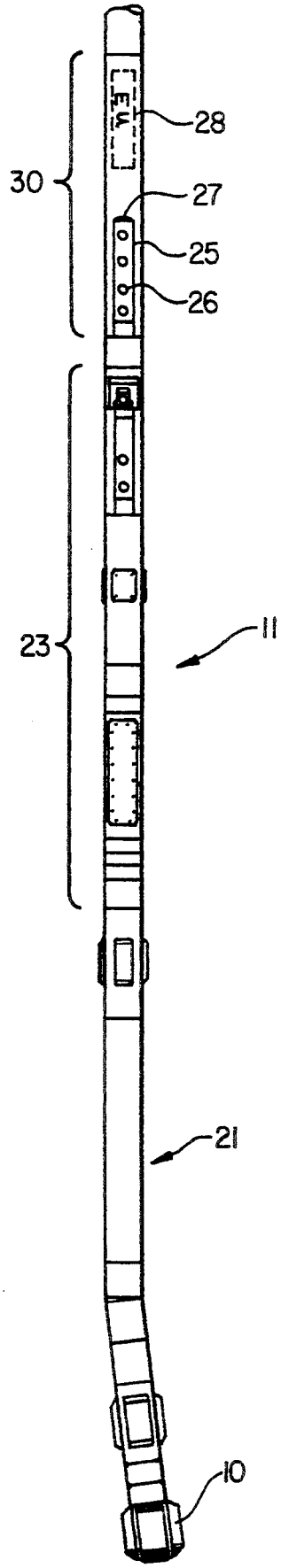
FIG. 2 is an elevation view of a drill string within which the preferred embodiment of the invention are implemented.

Referring now to FIG. 2, an example of the preferred embodiment of the invention will now be described in detail for the example of a directional drilling apparatus such as useful to drill a horizontal well. FIG. 2 illustrates the downhole end of drill string 4 with rotary drill bit 10 at its far end. According to this example, downhole mud motor 21 is adjacent to and powers drill bit 10. Of course, the present invention may also be utilized in a vertical drill string where the bit is powered by rotation of the entire drill string from the surface in the conventional manner.

In this example, bottomhole assembly 10 includes MWD sub 23 which contains conventional measurement-while-drilling transducers and communication equipment. It is preferred that MWD sub 23 contain sufficient equipment to analyze the surrounding formations so that a decision may be made to activate the sidewall sampling operation according to the preferred embodiment of the invention. Examples of such conventional MWD measurements include logging-while-drilling (LWD) parameters of correlation, resistivities, shale volume, porosity, lithology, rugosity, and free gas detection. In addition, drilling parameters such as drilling mechanics, direction and inclination, as well as short-normal resistivity and gamma ray detection, may be provided by MWD sub 23.

Above MWD sub 23, according to this embodiment of the invention, is sidewall-sampling-while-drilling ("SWD") tool 30. SWD tool 30 is preferably constructed as a sub of increased thickness relative to conventional drill pipe (similar to drill collar material), with a hollow cylindrical interior for the transmission of drilling mud and the detection of mud pulses, as will be described hereinbelow. A typical length for SWD tool 30 is on the order of twenty feet. SWD tool 30 includes an electronic unit 28 to control its operation. One or more side-pocket mandrels 27 are formed in tool 30 to hold gun assembly 25. Gun assembly 25 houses multiple guns 26, each of which includes a sampling cup bit that can be fired radially outward from SWD tool 30 into the surrounding formation, by an explosive charge, to obtain a rock sample. Cable or another type of retention member (not shown) allows for the withdrawal of the sampling bits along with SWD tool 30 in the manner described hereinbelow.

Also included with SWD tool 30 is electronic unit 28. Electronic unit 28 includes mud pulse receiver transducers and accompanying power and switching circuitry for receiving a mud pulse signal from within the interior of drill string 4 and for activating an explosive charge in a selected one of guns 26 in response thereto. It is contemplated that electronic unit 28 will be implemented within the pipe wall of SWD tool 30, as is conventional in the art for mud pulse receiver transducers and MWD electronics.

Figure 3B:
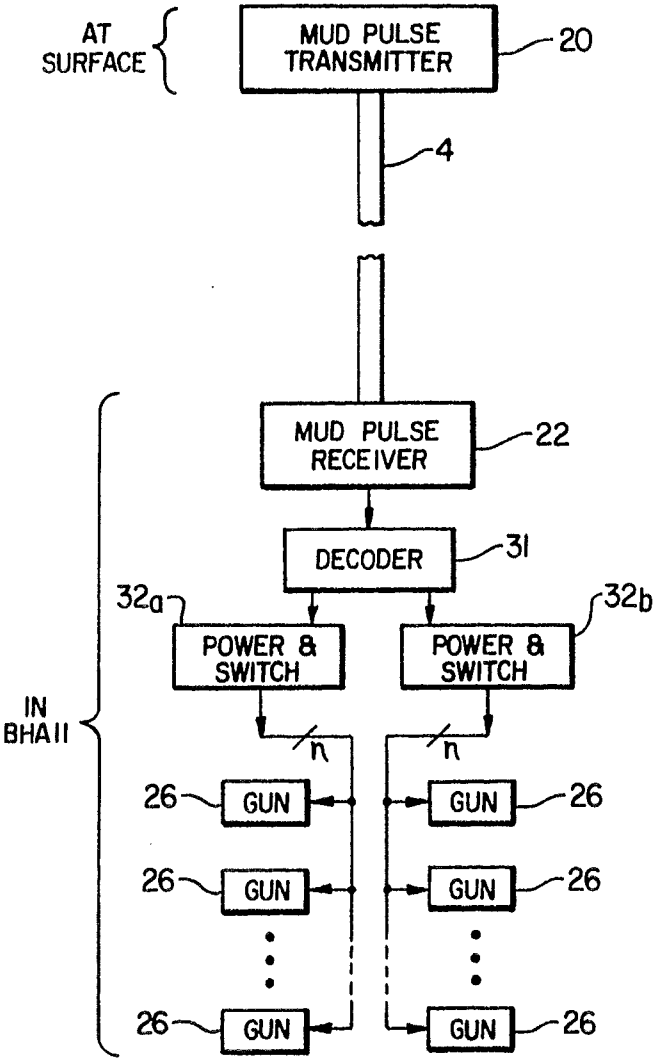
FIGS. 3*a* and 3*b* are schematic diagrams, in block form, of the sampling system according to alternative embodiments of the invention.
Figure 3A:
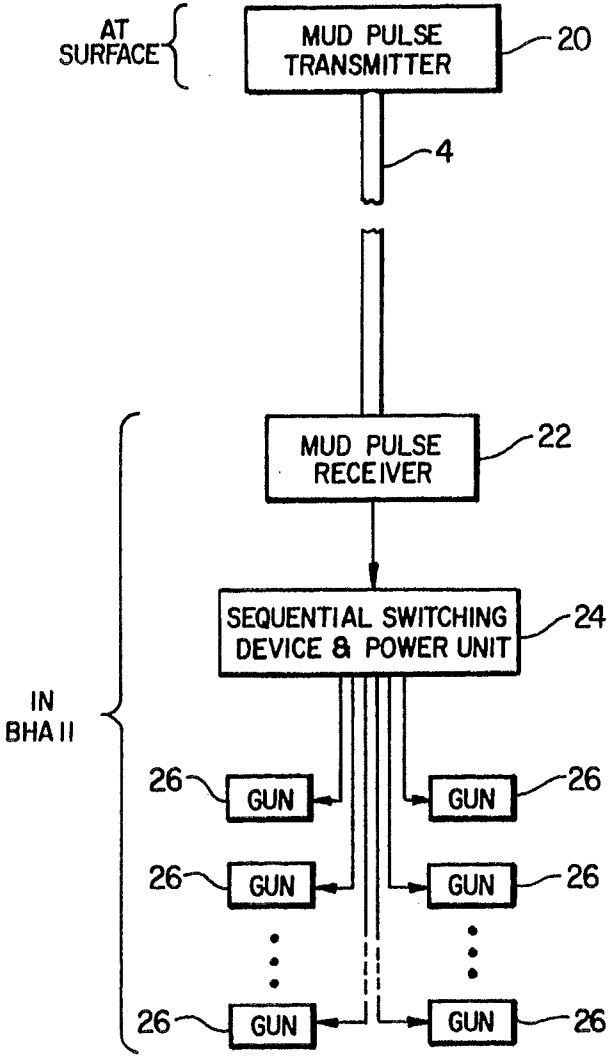

Referring now to FIG. 3a, the system for obtaining physical samples of the sidewalls of wellbore WB, and thus of the formations through which drilling is being performed, will now be described. This system includes mud pulse transmitter 20 located at the surface, which is controllable to generate a pressure differential in the drilling mud flowing from the surface into drill string 4 toward drill bit 10. Mud pulse transmitter 20 is preferably a removable device that is installed at the top of drill string 4 at the time that a sample is to be obtained; as such, transmitter 20 is not in the way during drilling so as not to affect the drilling mud flow. The mud pulse signal produced by transmitter 20 may be a flow restriction (decreased pressure downhole), vent (increased pressure downhole), frequency modulation, or any other known technique for transmitting information by way of pressure pulses in the drilling mud.

Mud pulse receiver 22, located within BHA 11, is in fluid communication with drill string 4 and is of the conventional type for detecting increased or decreased mud pressure, or alternatively for detecting a frequency modulated mud pulse signal. Mud pulse receiver 22 produces an electrical signal in response to the detected mud pulse(s), and forwards this electrical signal to sequential switching device and power unit (switch/power unit) 24. Receiver 22 and switch/power unit 24 correspond to electronic unit 28 of FIG. 2.

Switch/power unit 24 in turn is individually connected to each of guns 26 by way of an electrical conductor. According to this embodiment of the invention, each of guns 26 includes an explosive charge for firing a sampling bit into the sidewall of the wellbore surrounding drill string 4. The construction of guns 26 will be described in further detail hereinbelow.

Switch/power unit 24 includes sufficient electronics to detect the signals produced by receiver 22, and to forward an electrical signal to one of guns 26 sufficient to fire an explosive charge therein. Switch/power unit 24 selects, in a sequential order, the one of guns 26 to which the fire signal is to be sent in response to detection of a mud pulse by receiver 22. Accordingly, receiver 22 may be quite simple in construction and operation, as the mud pulse communicated thereto may be a single pulse and need not contain information regarding which of guns 26 is to be fired. Upon receipt of a pulse by receiver 22, and receipt of the corresponding signal by switch/power unit 24, switch/power unit 24 biases the next one of guns 26 in the predetermined sequence with sufficient energy to detonate the explosive charge therein; a counter or similar mechanism within switch/-power unit 24 will then increment so that the next mud pulse received by receiver 22 will cause the activation of the next one of guns 26 in the sequence.

Referring now to FIG. 3b, an alternative system according to the present invention will now be described. In this alternative embodiment of the invention, guns 26 are grouped into two or more groups, each controlled by a separate switch/power unit 32. As a result, a first level of redundancy is provided in the system of FIG. 3b, providing more reliable operation in the hostile downhole environment at a cost of requiring more complex data transmission from the surface to downhole. While it is preferable for maximum redundancy that each gun 26 have its own decoder and switch/power unit 32*a*, 32*b*, it is contemplated that optimization of the cost-redundancy tradeoff will generally result in the provision of electronics for each group of several units, similarly as shown in FIG. 3*b*.

As shown in FIG. 3*b*, similarly as in the case of FIG. 3*a*, mud pulse transmitter 20 is located at the surface end of drill string 4 and mud pulse receiver 22 is located in BHA 11. According to this alternative embodiment of the invention, the electrical output of mud pulse receiver 22 is coupled to decoder 31, which in turn has individual electrical outputs connected to each of switch/power units 32*a*, 32*b*. Each of switch/power units 32*a*, 32*b* control the firing of n guns 26 within its group. As above, switch/power units 32*a*, 32*b* are sequential switching units with sufficient power outputs to detonate explosive charges in guns 26.

In operation, the system of FIG. 3*b* communicates a coded mud pulse transmission from transmitter 20 to receiver 22, which then converts the mud pulse signal into an electrical signal and applies the electrical signal to decoder 31. Decoder 31 decodes the electrical signal corresponding to the coded mud pulse transmission, and determines which switch/power unit 32*a*, 32*b* is to be activated and thus from which group of guns 26 the desired gun is to be fired. Accordingly, the mud pulse transmission in the system of FIG. 3*b* is necessarily more complex than that in the system of FIG. 3*a*, as the signal must include sufficient information to select the desired group of guns. Of course, the complexity of the data and, accordingly, the data rate of the transmission, need not be very high, considering that the selection required is one of two (in the case of FIG. 3*b*).

In this way, the system of FIG. 3*b* allows for the continued sampling of the formation surrounding drill string 4 even if one of switch/power units 32 fails. As is well known, the downhole environment is quite hostile to electronic equipment, especially considering the mechanical shock and load presented by the drilling operation. The multiple groups of guns 26 with redundant switch/power units 32*a*, 32*b* provides a first level of redundancy to the system of FIG. 3*b*.

Further in the alternative, if the signal transmission is made more complex and if switch/power unit 32*b* is constructed accordingly, it is contemplated that the mud pulse transmission may select a single gun 26 from the entire population. Such selection may be especially useful, if the surface operator considers the orientation of the guns 26 in bottomhole assembly 11 and selects a sample accordingly.

Still further in the alternative, other telemetry techniques may be used to activate guns 26, as well as to select a bank of guns 26 or even an individual gun 26. Examples of such other telemetry techniques include hardwired telemetry, stress wave telemetry, and magnetostrictive telemetry, all of which are known in the art for the telemetry of information along a drill string. It is contemplated that mud-pulse telemetry is preferred, however, as it is a well-developed and simple technology, and as the data rates required for the enabling of the sidewall sampling according to the preferred embodiment of the invention are sufficiently low that mud-pulse telemetry is adequate.

It may also be desirable to provide a communication system by way of which bottomhole assembly 11 can acknowledge receipt of the mud pulse firing signal to the surface operator. For example, a mud pulse transmitter may itself be provided within bottomhole assembly 11, and a receiver located at the surface, so that acknowledgement of the successful firing of a gun 26 may be communicated to the surface. Alternatively, the firing of the explosive charge in gun 26 may be detectable by an acoustic sensor provided at the surface end of drill string 4; in some cases, of course, the firing of gun 26 may actually be audible to humans at the surface. Considering the hostile downhole environment to electronics, such acknowledgement of the firing of a gun 26 is highly preferred.

Figure 4:
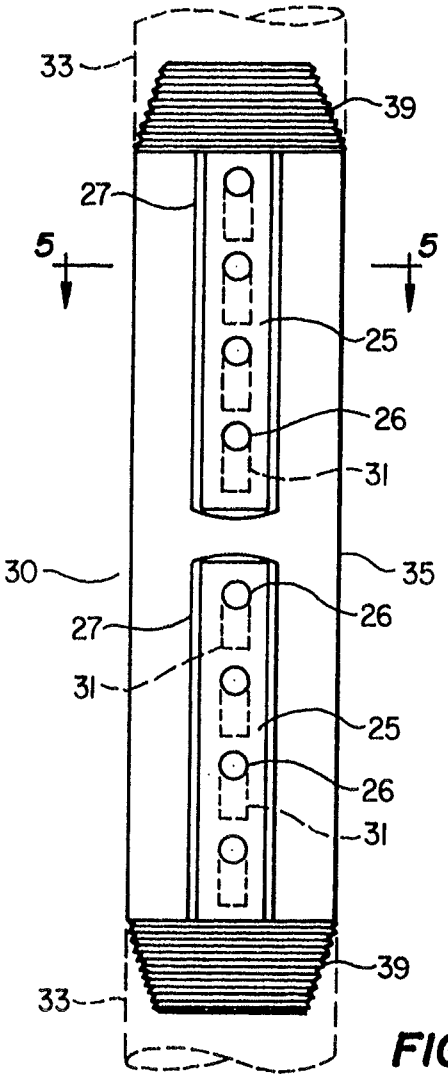
FIG. 4 is an elevation view of a portion of the bottomhole assembly of FIG. 2 illustrating the tool according to the preferred embodiment of the invention.
Figure 5:
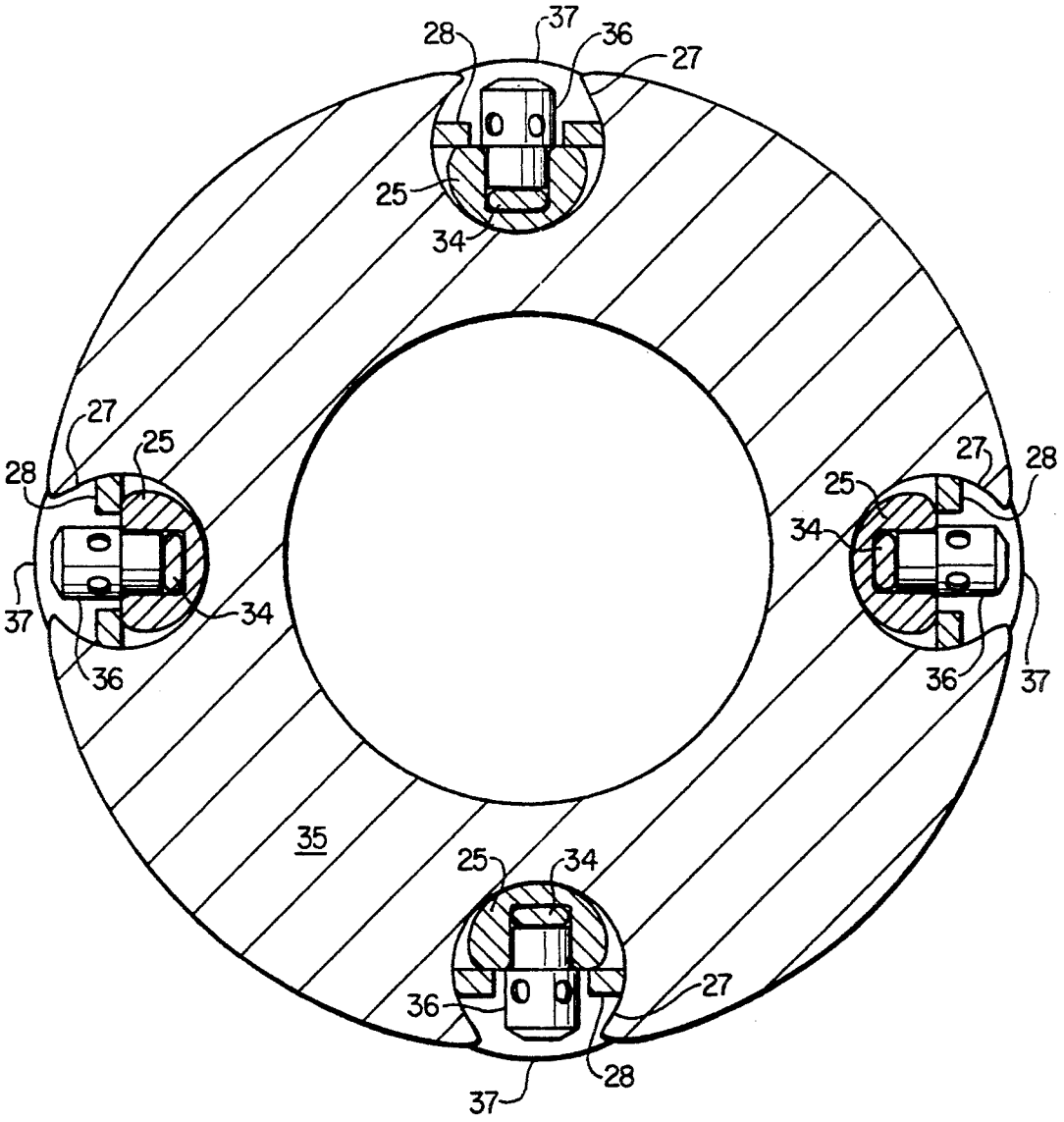
FIG. 5 is a plan cross-sectional view of the tool of FIG. 4.

Referring now to FIGS. 4 and 5, the construction of SWD tool 30 will be described in further detail. SWD tool 30, as noted above, is implemented into a sub formed of thick-walled drill pipe 35 of substantially the same diameter as the remainder of drill string 4; such thick-walled drill pipe 35 is commonly referred to as drill collar. Pipe 35 includes threaded ends 39, for mating with cooperating tool joint 33 (shown in phantom in FIG. 4).

Drill pipe 35 in SWD tool 30 according to the preferred embodiment of the invention includes side-pocket mandrels 27 around its outer perimeter, into which guns 26 will be deployed as will be discussed hereinbelow. Side-pocket mandrels 27 are formed by conventional subtractive machining of the walls of drill pipe 35. As shown in FIG. 5, side-pocket mandrels 27 in this example have a circular cross-section; of course, rectangular, trapezoidal, and other cross-sectional shapes may be used. In this example, mandrels 27 face outwardly from pipe 35, and are oriented 90° from one another in two sets (upper and lower); alternatively, as shown in FIG. 2, only a single set of mandrels may be provided.

Gun assemblies 25 each include a number of sampling guns 26, and are of such size as to fit within side-pocket mandrels 27. As shown in the cross-section of FIG. 5, gun assemblies 25 may be of a different shape from the cross-section of side-pocket mandrels 27; in the example, a retention plate 28 is also placed into mandrel 27 to retain gun assembly 25 therein. Alternatively, side-pocket mandrels 27 may be machined to closely match the cross-section of gun assemblies 25 so that no other retention device is required. It is preferred that gun assemblies 25 slidably mate with side-pocket mandrels 27 for ease of replacement between sampling operations. Installation is effected by sliding gun assemblies 25 into side-pocket mandrels 27 when tool 30 is at the surface (with retention plate 28 also slid thereinto, if necessary). Gun assemblies 25 are held in place by threading tool joints 33 onto threads 39 of drill pipe 35 after insertion, and as drill string 4 is assembled.

Referring still to FIG. 5, each gun 26 includes sampling bit 36, having a shape suitable for the expected formation as is well known in the art, and oriented with its open end facing radially outward from drill pipe 35. Explosive charge 34 is provided behind sampling bit 36, and receives power wires (not shown) from a switch/-power unit as described hereinabove, by way of which charge 34 is detonated. Thin cover 37 is present over the outside of sampling bit 36 to prevent the packing of the cup with drilling mud and cuttings during the drilling operation. Cover 37 will break apart upon the firing of charge 34, with the central portion likely driven into the interior of bit 36 and the remainder falling into the wellbore.

It is preferred that a pressure activated safety switch be provided for each of gun assemblies 25, so that guns 26 cannot be activated unless they are subjected to a pressure of on the order of a 200 foot column of water. Guns 26 are thus enabled only under high pressure, such as in a downhole environment, so that guns 26 will not inadvertently fire at the surface, when not yet deployed within drill string 4.

Figure 6:
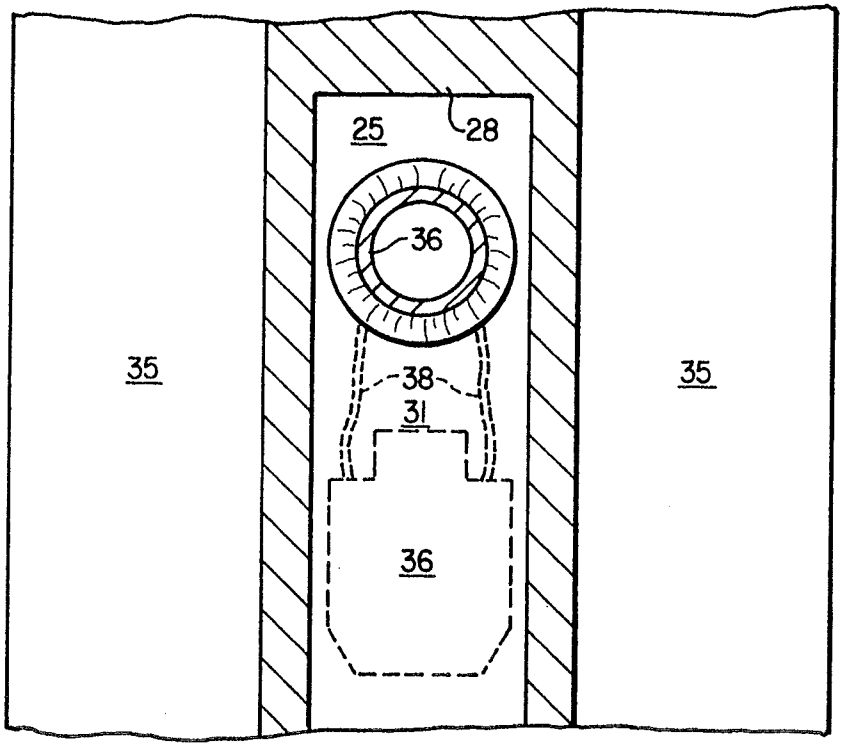
FIG. 6 is an enlarged elevation view of a portion of the tool according to the preferred embodiment of the invention, illustrating (in phantom) a suspended bit after sampling has occurred.

FIG. 6 is an enlarged elevation view of a portion of tool 30, illustrating another feature of SWD tool 30 according to the preferred embodiment of the invention. FIG. 6 illustrates gun assembly 25 prior to its firing (with cover 37 not shown), and shows, in phantom, sampling bit 36 suspended by cables 38 as conventional in the art. Cables 38 are each preferably aircraft cable of ¼" diameter, each fastened between gun assembly 25 and on a rearward portion of sampling bit 36. Upon sampling of the formation by detonation of charge 34, sampling bit 36 is driven into the formation surrounding the wellbore to force a portion thereof into its cylindrical cup. As drill string 4 is pulled slightly toward the surface to retrieve tool 30, cables 38 will pull sampling bit 36 out of the formation in the conventional manner. According to the preferred embodiment of the invention, open portion 31 of mandrel 27 is provided to receive sampling bit 36, suspended by cables 38, within the outside diameter of SWD tool 30 and the remainder of drill string 4. Accordingly, sampling bit 36 (and the sample contained therein) will not be lost as drill string 4 and BHA 11 are withdrawn from the wellbore.

In operation, BHA 11 with SWD tool 30 is placed within drill string 4 above bit 10, as shown in FIGS. 1 and 2. In the preferred embodiment of the invention, MWD tool 23 (preferably located directly below SWD tool) obtains real-time information regarding the surrounding formations, which may be correlated with survey and other previously acquired data for the particular drilling location. Covers 37 remain in place over sampling bits 36 in SWD tool 30 during this drilling operation.

At such time as the drilling operator decides to obtain an actual rock sample from the formation surrounding BHA 11, based upon the real-time MWD measurements obtained by MWD tool 23 and communicated to the surface by way of mud-pulse or other telemetry, the drilling operation is temporarily stopped. It is preferred that this sampling be performed at such time as the drill string 4 is about to be withdrawn from wellbore, such as to replace worn drill bit 10, so that the samples obtained by SWD tool 30 are not dislodged by further drilling activity. At this time, the operator enables mud pulse transmitter 20 (FIGS. 3*a* and 3*b*) to send a signal to BHA 11 to detonate one of sampling bits 36 into the surrounding formation; as noted above, mud pulse transmitter 20 is preferably installed at the surface end of drill string 4 only when needed to send such a signal. Upon receipt of the mud pulse signal as described above, SWD tool 30 fires a sampling bit 36 into the surrounding formation to obtain a sample. The transmission of mud pulses and the firing of sampling bits 36 continue until the desired number of samples are obtained. Upon retrieval of drill string 4 and BHA 11 from the wellbore, analysis of the rock samples obtained by sampling bits 36 may then be performed.

Alternatively, BHA 11 may not include MWD tool 23, in which case the activation of SWD tool 30 would be based solely on prior survey data and such other data obtained by conventional sources during the drilling operation.

The present invention provides significant advantages prior to the conventional MWD or core analysis techniques. First, actual core samples from the sidewalls of the wellbore are obtained, substantially immediately after the cessation of drilling. As such, the amount of filter cake in the sample is minimized, and the sample volume maximized. Actual accurate analysis of the wellbore formation may thus be performed, with a high degree of certainty concerning the depth of the sample. Indeed, by monitoring or observing the drill string 4 orientation, it is possible according to the present invention to obtain directional samples. Knowledge of the orientation of SWD tool 30 prior to firing enables the ability to analyze formations with permeability anisotropy, as samples may be taken in both the minimum and maximum permeability directions. The sample obtained by the present invention is thus more valuable.

Secondly, the efficiency of the wellbore drilling operation is much improved according to the present invention, especially where conventional core sampling is also used. The SWD tool according to the present embodiment of the invention enables on-site rock sample analysis, based upon which drilling decisions may be quickly made, rather than waiting for off-site analysis of a conventional core sample. In addition, the SWD tool according to the present invention obtains an actual formation sample at a relatively low cost relative to conventional core sampling bits. This cost saving is especially significant, considering that the results of the sidewall sampling according to the present invention could lead to the conclusion that the reservoir is not of interest at that location; accordingly, a full core sample may be avoided for a location at which it would otherwise be performed without the sidewall sample analysis. Analysis of samples obtained by the SWD tool according to the present invention may be used to select the appropriate locations at which full core samples are to be obtained, maximizing the efficiency of the overall sampling program.

The present invention is also especially advantageous in horizontal wells, considering that conventional wireline sampling cannot be performed in such wells except at excessive cost.

While the invention has been described herein relative to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings.

It is contemplated that such modifications and alternatives are within the scope of this invention as subsequently claimed herein.

We claim:

1. A tool for obtaining samples of the earth surrounding a wellbore, comprising:
   a sub, having first and second ends for coupling within a drill string, said sub having a mandrel along an exterior surface, said mandrel having an open cross-section extending to the first end of said sub;
   a gun assembly removably disposed within said mandrel, comprising:
      a gun assembly housing, having a size and shape allowing it to be inserted into said mandrel from the first end of said sub;
      a plurality of sampling bits, disposed within said gun assembly housing; and
      a plurality of charges, each coupled to one of said plurality of sampling bits, for firing its associated sampling bit in an outward direction from said sub; and
   an electronic unit located in said sub, for controlling said gun assembly responsive to a remote signal.

2. The tool of claim 1, wherein said sub has a plurality of mandrels spaced apart around its exterior surface;
   and wherein said tool further comprises a plurality of gun assemblies, each removably disposed within one of said plurality of mandrels.

3. The tool of claim 1, wherein said electronic unit comprises:
   a receiver for receiving said remote signal and for generating a firing signal responsive to said remote signal;
   a switch unit, having an input for receiving said firing signal, for activating the firing of one of said plurality of charges responsive to receiving said firing signal.

4. The tool of claim 3, wherein said switch unit is a sequential switching unit, so that said plurality of charges are activated in a sequence responsive to receiving a sequence of said firing signals.

5. The tool of claim 3, wherein said receiver is a mud pulse receiver, for receiving a mud pulse and generating an electrical signal responsive thereto.

6. The tool of claim 1, wherein said electronic unit comprises:
   a receiver for receiving said remote signal and for generating an electrical signal responsive thereto;
   a decoder, for receiving the electrical signal from said receiver, and having a plurality of selectable outputs, said decoder presenting a firing signal at one of said plurality of outputs selected responsive to information communicated by said electrical signal; and
   a plurality of switch units, each having an input coupled to one of said plurality of outputs of said decoder, for receiving the firing signal from said decoder;
   wherein said plurality of charges are arranged in groups, each group associated with one of said switch units, so that the selected switch unit activates the firing of one of said plurality of charges responsive to receiving said firing signal.

7. The tool of claim 6, wherein said receiver is a mud pulse receiver, for receiving a mud pulse and generating an electrical signal responsive thereto.

8. The tool of claim 1, further comprising: a drill string, coupled to one end of said sub; and a drill bit, coupled to another end of said sub; wherein said sub is connected nearer said drill bit than to the distal end of the drill string from said drill bit.

9. The tool of claim 1, wherein said gun assembly further comprises:
   a plurality of cables, each connected between said gun assembly housing and an associated one of said plurality of sampling bits.

10. A tool for obtaining samples of the earth surrounding a wellbore, comprising:
   a sub, having ends for coupling within a drill string, said sub having a mandrel along an exterior surface;
   a gun assembly disposed within said mandrel, comprising:
      a sampling bit; and
      a charge coupled to said sampling bit, for firing said sampling bit in an outward direction from said sub;
   an electronic unit located in said sub, for controlling said gun assembly responsive to a remote signal; and
   a measurement-while-drilling sub, comprising a plurality of transducers for measuring formation parameters at a downhole location, coupled in series with said drill string, said sub, and said drill bit.

11. The tool of claim 10, wherein said measurement-while-drilling sub is coupled between said sub and said drill bit.

12. A method for obtaining samples of the formation from the sidewalls of a wellbore, comprising:
   assembling a tool comprising a sub having first and second ends for coupling within a drill string and having a mandrel along an exterior surface, said mandrel having an open cross-section extending to the first end of said sub, by sliding a gun assembly into said mandrel from the first end of said sub, said gun assembly comprising:
      a housing, having a size and shape allowing it to be inserted into said mandrel from the first end of said sub;
      a plurality of sampling bits disposed within said housing; and
      a plurality of charges, each coupled to one of said plurality of sampling bits;
   coupling said sub within the drill string near a drill bit;
   drilling a wellbore with the drill bit;
   activating one of said plurality of charges to fire its associated sampling bit into the formation adjacent said sub;
   withdrawing said drill string and sub from said wellbore, so that the sample of the formation obtained by said sampling bit after the activating step may be analyzed;
   detaching the first end of the sub from the drill string; and
   slidably removing the gun assembly from the mandrel in said sub.

13. The method of claim 12,
   wherein said activating step comprises activating, in sequence, the charges associated with said plurality of sampling bits, to fire said plurality of sampling bits into the formation surrounding the wellbore in sequence.

14. The method of claim 12, wherein said activating step activates a selected charge associated with a selected one of said plurality of sampling bits.

15. The method of claim 12, wherein said activating step comprises:

transmitting a signal from the surface to the tool, said tool comprising a receiver for detecting said signal and a switch unit for activating said charge.

16. The method of claim 15, wherein said transmitting step comprises transmitting a mud pulse.

17. The method of claim 15, further comprising:

after said activating step, transmitting a signal from the tool to the surface to acknowledge activation of said charge.

18. A method for obtaining samples of a formation from the sidewalls of a wellbore, comprising:

drilling a wellbore with a drill bit coupled to the distal end of a drill string from the surface, said drill string including a tool coupled within said drill string, and located near said drill bit, said tool comprising:

a sub, having ends for coupling within a drill string, said sub having a mandrel along an exterior surface;

a gun assembly disposed within said mandrel, comprising:

a sampling bit; and a charge coupled to said sampling monitoring formation parameters during said drilling step;

activating said charge to fire the sampling bit into the formation adjacent said sub, responsive to the results of said monitoring step; and withdrawing said drill string and sub from said wellbore, so that the sample of the formation obtained by said sampling bit after the activating step may be analyzed.

19. The method of claim 18, further comprising:

stopping said drilling operation prior to said activating step.

* * * * *